US005992054A

United States Patent [19]

Rauch

[11] Patent Number: 5,992,054

[45] Date of Patent: Nov. 30, 1999

[54] SHOE AND PROCESS FOR SEALING THE SOLE AREA OF A SHOE

[75] Inventor: Max Rauch, Grunwald, Germany

[73] Assignee: W.L. Gore & Associates, Inc., Newark, Del.

[21] Appl. No.: 09/048,485

[22] Filed: Mar. 26, 1998

Related U.S. Application Data

[63] Continuation-in-part of application No. 08/817,715, filed as application No. PCT/EP95/04011, Oct. 11, 1995, abandoned.

[30] Foreign Application Priority Data

Oct. 12, 1994 [DE] Germany ..... 44 36 495

[51] Int. Cl.[6] ..... A43B 1/14; A43B 9/12; A43B 9/16; A43D 25/20

[52] U.S. Cl. ..... 36/30 R; 36/30 A; 36/14; 36/32 R; 12/148; 12/142 E; 12/142 RS; 12/146 BR

[58] Field of Search ..... 36/98, 14, 19.5, 36/22 R, 30 R, 30 A, 32 R; 12/142 E, 142 F, 142 RS, 145, 146 BR, 148

[56] References Cited

U.S. PATENT DOCUMENTS

| | | | |
|---|---|---|---|
| 2,607,061 | 8/1952 | Leahy et al. . | |
| 3,852,895 | 12/1974 | Funck | 12/142 R |
| 4,096,129 | 6/1978 | Cook | 260/77.5 |
| 4,125,522 | 11/1978 | Becker | 36/19.5 |
| 4,703,533 | 11/1987 | Barma | 12/142 E |
| 4,831,750 | 5/1989 | Muller | 36/30 R |
| 4,837,245 | 6/1989 | Streu et al. | 521/117 |
| 5,494,941 | 2/1996 | Lutter et al. | 521/159 |
| 5,596,063 | 1/1997 | Lutter et al. | 528/44 |
| 5,597,885 | 1/1997 | Lutter et al. | 528/44 |
| 5,624,758 | 4/1997 | Maksymkiw et al. | 36/19.5 |
| 5,678,326 | 10/1997 | Pavelescu | 36/14 |
| 5,890,248 | 4/1999 | Gee | 36/30 A |

FOREIGN PATENT DOCUMENTS

| | | |
|---|---|---|
| 0 269 873 | 6/1988 | European Pat. Off. . |
| 0 437 721 A1 | 7/1991 | European Pat. Off. . |
| 0 555 742 A2 | 8/1993 | European Pat. Off. . |
| 0 629 359 A3 | 12/1994 | European Pat. Off. . |
| 43 11 768 A1 | 4/1993 | Germany . |
| 4224702 | 8/1992 | Japan . |
| 4132401 | 11/1992 | Japan . |

*Primary Examiner*—Paul T. Sewell
*Assistant Examiner*—Anthony Stashick
*Attorney, Agent, or Firm*—Gary A. Samuels

[57] ABSTRACT

A process which serves to seal and waterproof the outsole-side end area of a waterproof shoe shaft and/or to pad the outsole-side end of a shoe by putting a liquid, curable, filling material into the space between the insole and outsole is described. The outsole is provided with an input opening for putting in the filling material. The outsole is adhered to the shaft only in a circumferential area and in such a way that the outsole-side end area of the shaft remains unadhered. The liquid filling material is put in through the input opening, between the insole and the outsole, from where it flows into the outsole-side end area of the shaft due to its good flowability. The liquid material contains polyurethane precursor ingredients which react to form a foam polyurethane.

14 Claims, 2 Drawing Sheets

SHOE AND PROCESS FOR SEALING THE SOLE AREA OF A SHOE

CROSSREFERENCE TO RELATED APPLICATIONS

This application is a continuation-in-part of application Ser. No. 08/817,715 filed Jul. 3, 1997, now abandoned, which is a 371 of PCT/EP95-04011 filed 1995.

FIELD OF THE INVENTION

The invention relates to a shoe and to a process for sealing of the end area of a shoe shaft that faces the inner side of the outsole. The material used to seal may also waterproof and/or provide an impact-dampening or padding effect in a shoe in which the outsole is adhesively bonded by input of a filling material between the outsole and the insole.

BACKGROUND OF THE INVENTION

The sealing of the end area of the shoe shaft adjacent the outsole is particularly problematic for shoes especially waterproof shoes. This applies in particular to waterproof and breathable shoes the shafts of which are provided with an upper material, e.g., a textile or leather and a lining with a waterproof and water vapor permeable, i.e., breathable, functional layer.

Conventional lasting processes, wherein an insole is mounted to a last and an outsole-side end area of the shoe shaft is turned over a circumferential edge area of the insole and glued to the insole, require numerous production steps and cause problems when the lasting area is to be sealed. To make such lasted shoes, first the circumferential edge of the insole is covered with glue. The lasting is then effected in three zones and stages. First at the shoe tip, then at the side area, and finally the heel area is adhered. After each step, process time must elapse before the adhesive becomes sufficiently sticky. After the three stages, the adhesive is reactivated and thus softened in order to homogenize the transitions between the individual adhesive zones. This is intended to prevent insufficiently adhered spots at the zone interfaces through which water could penetrate.

Like other production processes, the lasting process is susceptible to the formation of water bridges at the outsole where the lining has a transition to the upper material. Since wrinkles caused by lasting often result in gaps in the adhesive through which water can penetrate, an adhesive layer is applied over the full surface after the lasting process in order to securely seal such wrinkles.

A laminate can be used as the waterproof, breathable, functional lining. This laminate lining comprises a liner, a foam-like plastic or a woven felt; a functional layer, preferably a membrane of stretched, microporous polytetrafluoroethylene (PTFE) and a backing fabric in the form of a textile reinforcement of the functional layer. In order to waterproofly bond the functional layer with an adhesive to the insole, the functional layer is laid open by a process known as skiving. During this process the liner and the foam are removed in this region. The foam affords a certain tolerance so that the liner can be removed from the functional layer without damaging it. It is only to allow for such a destruction-free stripping process that the entire lining laminate is provided with a foam layer. The necessity to cover the entire liner with a foam layer makes the lining laminate more expensive. Applying the adhesive, lasting zone by zone and covering the whole surface with adhesive to make the construction tight requires expensive manual work and long standstill times on the lasts. Therefore these process steps cause considerable production costs and the production throughput is so low that the number of shoes produced per unit of time does not fit into a mass production concept.

Such problems have been overcome by the process described in DE 3712901 C1 wherein a molding form is applied to the underside of the shoe shaft which has been lasted to the circumference of the insole. Said mold comprises a sealing lip arrangement which protrudes towards the lasted shaft area and which is shaped like the circumference of the insole. Through this injection mold liquid sealing material which hardens later is injected into the area limited by the sealing lip arrangement. During the lasting process an inner edge area of the lasted area is kept free from adhesive. The sealing material can thus seal this inner edge area of the lasted area when injected through the mold. This known injection molding process has proven to be suitable for producing waterproof shoes. However, the shoe manufacturer must make cost-intensive investments because he must buy a suitable injection machine.

It is basically state of the art to use an insole opening for injection of a curable material. U.S. Pat. No. 2,607,061 describes injection of adhesive into a central axial channel of a high heel to adhesively attach the heel to the shoe.

Frequently there is a need for a shoe with an impact-dampening padding material so that whenever the wearer's foot steps on the floor or ground while walking or running the impact caused by the steps are attenuated.

SUMMARY OF THE INVENTION

The process is a process for sealing and/or padding the area between an upper and an insole, especially the area in which the upper is lasted around the insole, which comprises:

providing footwear comprising an insole and an outsole spaced apart, and an upper lasted around the insole, said outsole having an opening for inserting a liquid into the space between the insole and outsole;

providing a liquid filling mixture comprising methylene diisocyanate having an isocyanate content of 15–25% by weight, a polyol having an OH number between 60 and 280, water, and a catalyst for initiating reaction of the recited ingredients, the weight ratio of the polyol to diisocyanate being between 100:20 and 100:100;

introducing the liquid filling mixture through the opening and into said space, causing the liquid filling mixture ingredients to react and foam while filling said space, whereby the foamed reaction product formed is a polyurethane sealing material.

The product of the invention is a shoe comprising an insole and an outsole spaced apart, and an upper lasted around the insole, in which said space is filled with a foam formed from curing a mixture comprising a liquid filling mixture comprising methylene diisocyanate having an isocyanate content of 15–25%, a polyol having an OH number between 60 and 280, water, and a catalyst for initiating reaction of the recited ingredients, the weight ratio of the polyol to diisocyanate being between 100:20 and 100:100.

The outsole can be bonded to the shaft only in a circumferential area, in such a way that the outsole-side end area of the shaft remains such that it is not adhered to the outsole.

In the process each input opening in the outsole can be closed by a plug after the liquid filling material has been put in.

The shoe can be constructed as follows:

(a) an insole is mounted to a last;

(b) the upper material and the lining are sewn together at the upper shaft end;

(c) the upper material and the lining are cut to the same length at their outsole-side ends or are cut such that the lining protrudes over the upper material by about 3 mm;

(d) the upper material and the lining are glued together in the lasted area;

(e) the lasted area of the upper material and the lining bonded thereto are lasted to the insole;

(f) the outsole is provided with an input opening;

(g) the outsole is bonded to the outsole-side end of the shaft with the exception of the free end area of the lasting allowance; and (h) the liquid mixture is put through the input opening into the area between the insole and the outsole.

The shoe can have a waterproof shaft and a waterproof outsole. The outsole-side end area of the shaft is sealed with the foam polyurethane. The shaft is adhered to the outsole in such a way that the outsole-side end area of the shaft is free from the adhesive used for adhesively connecting the outsole.

In the shoe the polyurethane foam sealing material contains polyol with an OH-number preferably ranging between about 70 and 250 and isocyanate with an NCO-content preferably ranging between about 16 and 23. Preferably the polyether foam contains polyol with an OH-number of about 106 and isocyanate with an NCO-content of about 20.7.

The polyol and isocyanate are prepared in a weight mixture ratio ranging approximately between 100:20 and 100:100, preferably in a weight mixture ratio ranging between approximately 100:25 and 100:50, most preferably 100:38.

The shoe can have the outsole provided with at least one cavity which is open towards the insole in a central area within the circumference of the insole and that this open cavity is filled with the sealing material.

DETAILED DESCRIPTION OF THE INVENTION

Figure 1:
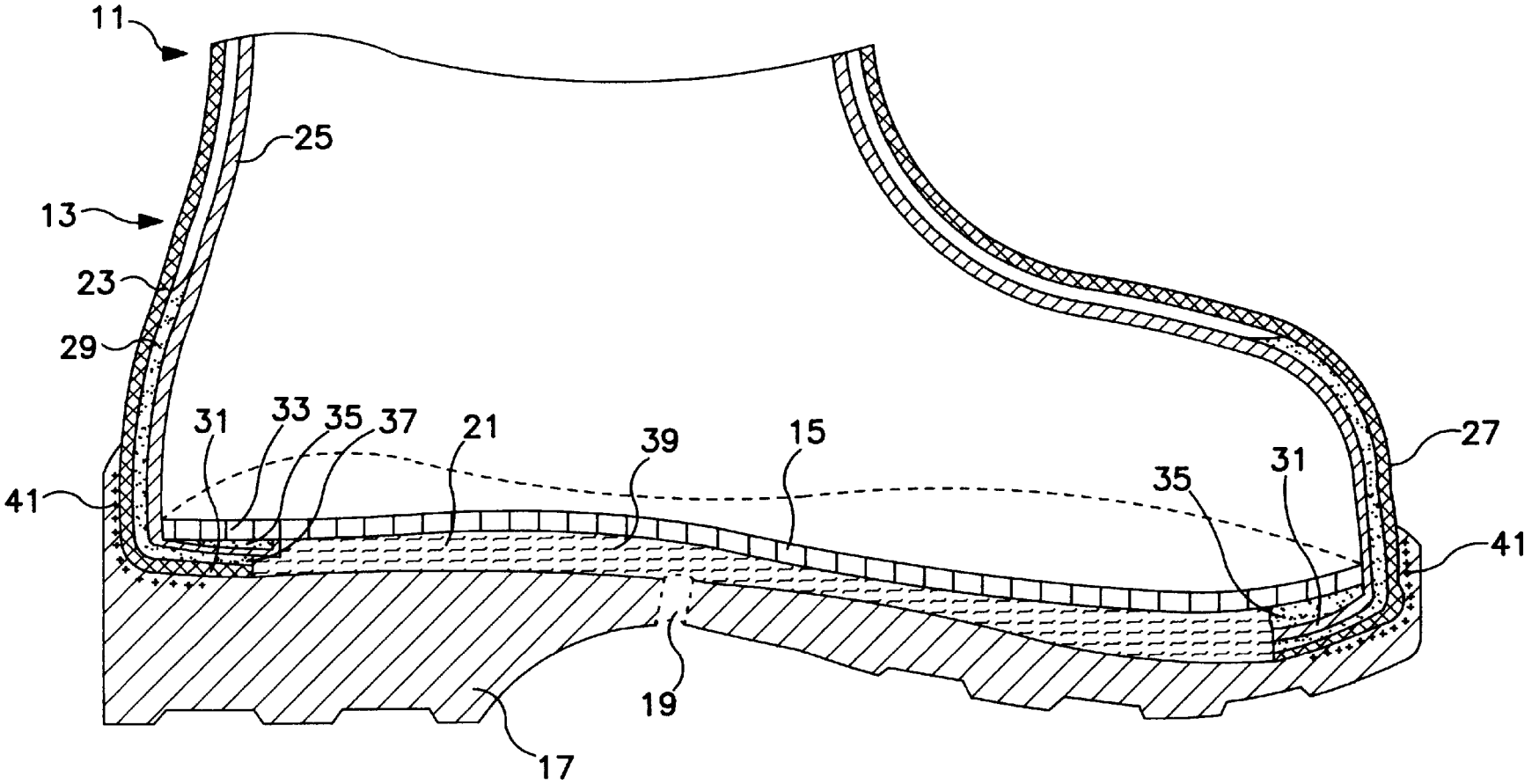
FIG. 1 depicts a longitudinal section through a shoe of the invention.

FIG. 1 is a cross-sectional view of a first embodiment of a shoe 11 of the invention, which incorporates a shaft 13, an insole 15, an outsole 17 with an input opening 19 and polyurethane foam sealing material 21 between the insole 15 and the outsole 17. The sealing material 21 is formed by reaction of the liquid filling mixture. The shaft 13 comprises an upper material 23 and a lining laminate 25. The lining laminate 25 is provided with a waterproof water-vapor permeable functional layer, preferably of expanded microporous PTFE, with a backing fabric consisting of a textile reinforcement material on the side facing the upper material 13 and with a liner layer on the opposite side. The individual layers of the lining laminate 25 are not shown in the drawings. In the toe area and the heel area of the shoe 11 there is a front cap 27 and a heel cap 29 consisting of a material which reinforces the shoe between the upper material 23 and the lining laminate 25.

In FIG. 1 the shoe has been produced in a lasting process. For this purpose a lasting area 31 of the shaft 13 on the outsole is turned around a circumferential area of the insole or lasted to this area and bonded to the circumferential area 33 of the insole by a lasting adhesive 35. At the free end of the lasted area 31 the upper material 23 and the lining laminate are either cut to the same length, as shown in the front cap area of the shoe, or the lining laminate is cut such that it protrudes by about 3 mm over the upper material, as shown in FIG. 1 for the heel cap area.

The outsole 17 is bonded to the upper material of the outsole-side end area of the shaft 13 in such a way that an end area 37 of the lasted area 31 remains free from the adhesive 41 which is used to glue the outsole 17. The adhesive 41 is symbolized by little crosses in the outsole area in FIGS. 1 and 2. In reality the adhesive 41 is of course located between the outsole 17 and the shaft 13. The liquid filling material 21 fills an interstice in a space 39 between the center area of the outsole 17 which is not glued to the shaft 13 and the center area of the insole 15 which is not covered by the lasting area.

The shoe can be produced as follows:

The upper material 23 and the lining laminate 25 are sewn together in the upper end area of the shaft 13 facing away from the outsole 17. On the end of the shaft 13 which faces the outsole the lining laminate 25 is cut to the same length as the upper material 23 or is cut such that it protrudes by about 3 mm above the upper material 23. The lining laminate 25 is glued to the upper material over a width of about 2 cm on the lasting area or lasting allowance 31, while the inner end area of the lasting allowance 31 may remain unglued. An insole 15 made of leather or a leather-like material made of man-made fibers or cotton is mounted on a last. Then the entire outsole-side end area of the shaft 13 is turned around the last and lasted to the insole 15 by means of a conventional lasting adhesive 35. Instead of an adhesive lasting process a lasting process may be used wherein the shaft is nailed to the insole, at least in the heel area.

After the shaft 13 has been lasted the upper material 23 is roughened in the area of the lasting allowance 31 and wrinkles in the lasting area 31, if any, are equalized by grinding, in particular in the tip and heel area. The lasting area is then covered by a conventional sole adhesive 41, of a type depending on the material of the outsole, in such a way that about 0.5 cm of the end area of the lasting area 31 are free from sole adhesive 41. Furthermore, the sole adhesive 41 is applied to a sufficiently-wide edge area of the outsole 17. The space 39 located within the inner edge of the lasted area 31 remains unglued.

The outsole has a hole which serves as an input opening in the area of the joint, i.e., between the treading area of the forefoot and the heel. This hole may also be located elsewhere in the outsole and/or insole because the liquid mixture which forms the polyurethane foam sealing material has a high flow and wicking capacity and fills the entire cavity between the insole and the outsole no matter where the hole is located. Through this input opening 19 the filling material 21 is put in when the shoe 11 is ready. It fills the intersole space 39, preferably with the outsole facing upwards. Subsequently, the input opening 19 is sealed, e.g., by a plug (not shown). The input opening 19 may, however, also be closed by a valve plug before the liquid reaction mixture is entered; through this plug the liquid reaction mixture can be applied as described and finally the plug is closed from inside by the curing sealant.

Due to its wicking capacity in the liquid state, the filling mixture will reach all existing wrinkles and channels of the lasting allowance 31 in the non-glued polytetrafluoroethylene part of the lasting allowance 31 and partly enters the structure of the upper material to seal these areas.

In FIG. 1, two embodiments are shown: In the shoe tip area an embodiment is shown in which the shell material 23 and the lining laminate 25 are cut to the same length in the lasting allowance; in the heel area an embodiment is shown wherein the lining laminate 25 projects over the shell material 23 in the lasting allowance.

Figure 2:
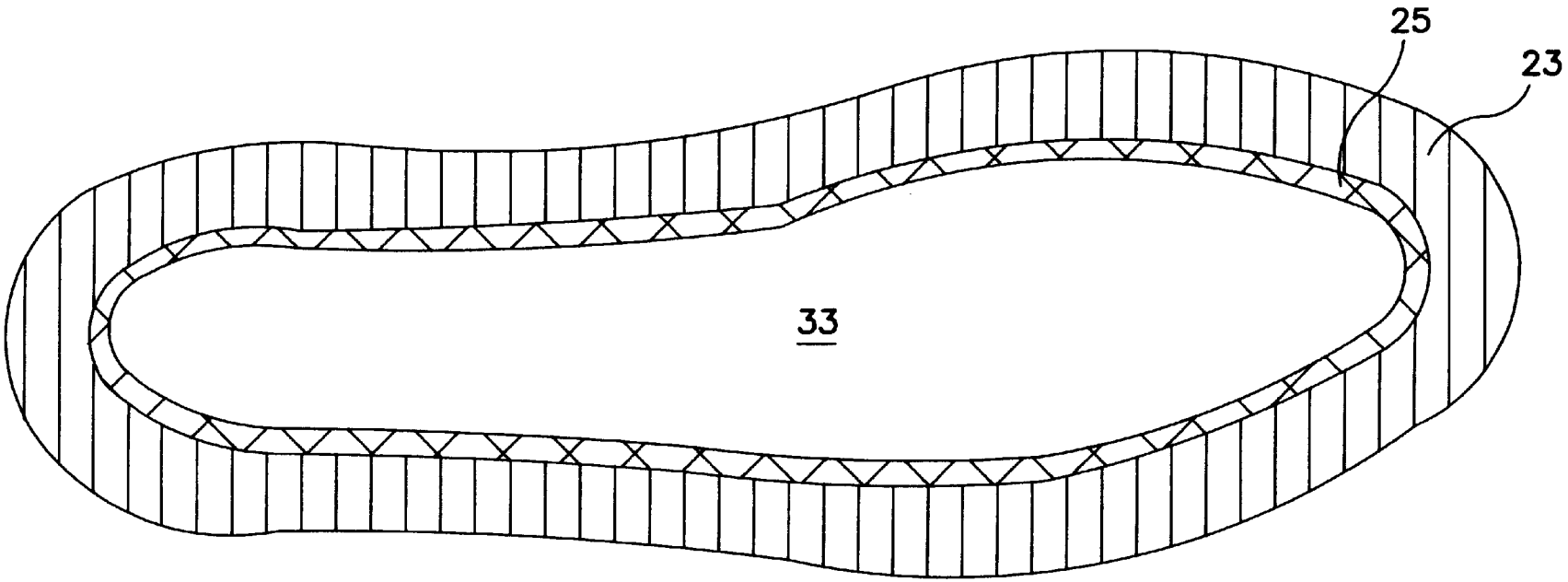
FIG. 2 is a top view from the bottom onto an insole and a lasted area of a shaft comprising an upper material and a lining laminate.

FIG. 2 shows an embodiment wherein the lining laminate 25 projects over the upper material 23 in the lasting allowance 31.

The process of the present invention has the following special benefits:

simple, automated production process;

production process suitable for mass production conditions;

the shoe manufacturer does not need to make big investments;

no reduction of production capacity because the process is not time-intensive;

less expensive than existing processes;

shock absorption effect in the whole sole area because the intersole space is filled with the sealing material;

the process may be used for ready-made soles of all types and thicknesses.

All that needs to be done to use this process of the invention is to provide the outsole and/or the insole with a hole through which the liquid mixture can be injected, by any convenient means, even a conventional syringe suffices. In commercial shoe production this process can be automated using known machinery without problems. Since the cured foam mass may solve the sealing problem, the lasting process becomes less work-intensive than in the conventional process. Therefore the invention considerably reduces costs and the shoe production process can be automated either fully or to a large extent.

The polyurethane filling mixture used in the invention has good flowability and bondability which helps to ensure a good sealing effect. This foam hardens almost without pressure and the liquid filling mixture can be entered into the cavity between the insole and the outsole virtually without pressure, e.g., by simply letting it flow in, if desired. As a consequence the mixture flows and expands as it moves into all cavities, even without exerting counterpressure on the insole and/or outsole and without deforming the insole and/or outsole. Due to these properties the liquid filling material allows for large tolerances of the cavity to be filled.

When the liquid mixture is entered into the shoe, the shoe can be positioned such that the outsole faces upwards so that the reaction mixture first wets the problem zones at the circumferential edge of the insole and then the foaming process begins from there. In this case liquid filling material (which has not yet reacted) enters the areas to be sealed first. If there is a functional layer with a textile backing side the latter is better penetrated by the filling material which has not yet foamed than it would be if the filling material had already foamed.

Before the foaming and hardening process, further components can be added to the liquid reaction mixture, e.g., to make the filling material antistatic. The filling material may also be mixed with electrically conductive particles. In connection with an insole, which incorporates a ground path completely through its thickness or a zone consisting of electrically conductive material, electrostatic charges can be conducted from the wearer's foot to the outsole, which can be made electrically conductive, too, by admixture of electrically conductive particles. In this way, the wearer's foot is, so to speak, "grounded." Before entering the liquid filling material, at least one prefabricated insertion part may be placed between insole and outsole; it will then be held stationary by the cured sealing material. The inserted part may, e.g., be a metal plate which prevents nails from penetrating into the shoe. The insertion part may also be an intermediate sole provided with air cushions or a dampening material. The insertion part may also be an electric battery to supply lamps mounted to the shoe with electric energy. Such insertion parts are held stationary in the desired position by the filling material.

The polyurethane foam expands to fill the space. There is an internal pressure which allows for the formation of foam, but which has no, or only a very low, pressure effect outwards. The foaming does not inflate the cavity between the insole and the outsole. The outsole is bonded to the shaft preferably only in a circumferential area in such a way that the outsole and area of the shaft is not bonded to the outsole. On the one hand, this closes the wrinkles formed during lasting. On the other hand, this causes the material to enter the upper material of the shaft and eliminates the water conductivity in this shaft area.

It is particularly advisable to provide the outsole with at least one cavity which is open towards the insole within the inner edge area of the lasting allowance. This cavity is filled with the filling material. Since the material is much lighter than the outsole material, this measure will reduce the overall weight of the shoe.

The cured foam polyurethane may also serve to pad and impact-attenuate the area between the insole and the outsole towards the outsole. This effect is achieved no matter whether the shoe is waterproof or not. In case of a waterproof shoe the filling material may additionally serve as a waterproof sealant. The benefit of such a padding is that it is not necessary to produce and keep on stock padding inlays in the various shoe sizes and shapes.

The process of the invention is not only suitable for shoes produced in a lasting process. It is suitable wherever the sealing between the upper material and the lining on the one hand and between the lining and the insole on the other hand, in the area connecting the shaft and the insole, needs to be particularly good.

When the lasting process is used it is particularly advantageous to cut the lining at the end facing the outsole to such a length that it is at least as long as the upper material or has an edge protruding over the upper material, preferably in a range of about 3 mm. It is also possible to not adhesively bond the upper material and the lining in their end areas facing the outsole so that the sealing material can enter these end areas between the upper material and the lining during the injection process.

I claim:

1. Process for filling the area between an upper and an insole, in which the upper is lasted around the insole, which comprises:

providing footwear comprising an insole and an outsole spaced apart, and an upper lasted around the insole, said outsole having an opening for inserting a liquid into the space between the insole and outsole;

providing a liquid mixture comprising methylene diisocyanate having an isocyanate content of 15–25% by weight, a polyol having an OH number between 60 and 280, water, and a catalyst for initiating a reaction of the recited ingredients, the weight ratio of the polyol to diisocyanate being between 100:20 and 100:100;

introducing the liquid mixture through the opening and into said space, causing liquid mixture ingredients to react and foam while filling said space, whereby the foam reaction product is a polyurethane material.

2. The process of claim 1 in which a polyol is a polyether or polyester-polyol.

3. The process of claim 1 in which the polyol has an OH-number in a range between about 70 and 250 and an isocyanate with an NCO content In a range between about 16 and 23.

4. The process of claim 3, wherein the polyol has an OH-number of 106 and the diisocyanate has an NCO-content of 20.7.

5. The process of one of claim 1 wherein the liquid mixture contains an antistatic material.

6. The process of claim 1 wherein the input opening is closed after the liquid mixture has been put in.

7. A process for waterproof sealing of the outsole-facing end area of a waterproof shoe shaft and/or for padding the outsole-facing area of a shoe with glued outsole by applying a liquid, curable, waterproof and/or padding filling material in which:

(a) a polyurethane foam is used as the filling material which foams almost without pressure, which has a high creepability in the liquid state and a high bondability and which is produced by cross-linking using polyol with an OH-number in a range between about 60 and 280 and isocyanate with an NCO-content in a range between about 15 and 25; and (b) the outsole and/or the insole is provided with an input opening at least at one spot lying within the area enclosed by the end area of the shaft, liquid-filling material is put through the input opening into the space between the insole and the outsole from where the filling material creeps up to the end area of the shaft facing the outsole, due to its high creepability.

8. A process characterized by the following process steps:

(a) an insole is mounted to a last;

(b) the upper material and the lining are sewn together at the upper shaft end;

(c) the upper material and the lining are cut to the same length at their outsole-side ends or are cut such that the lining protrudes over the upper material by about 3 mm;

(d) the upper material and the lining are glued together in the lasted area;

(e) the lasted area of the upper material and the lining bonded thereto are lasted to the insole;

(f) the outsole is provided with an input opening;

(g) the outsole is bonded to the outsole-side end of the shaft with the exception of the free end area of the lasting allowance; and (h) the liquid mixture of claim 1 is put through the input opening into the area between the insole and the outsole.

9. A shoe comprising an insole and an outsole spaced apart, and an upper lasted around the insole, in which said space is filled with a foam formed from curing a mixture comprising a liquid mixture comprising methylene diisocyanate having an isocyanate content of 15–25% by weight, a polyol having an OH number between 60 and 280, water, and a catalyst for initiating reaction of the recited ingredients, the weight ratio of the polyol to diisocyanate being between 100:20 and 100:100.

10. The shoe of claim 9 wherein the polyol is a polyester-polyol or a polyether-polyol.

11. The shoe of claim 9 wherein the polyol has an OH-number ranging between 70 and 250 and the diisocyanate has an NCO-content ranging between 16 and 23 percent by weight.

12. The shoe of claim 10 wherein the liquid mixture contains an antistatic material.

13. The shoe of claim 9 wherein the foam contains polyol and isocyanate units in a weight mixture ratio between 100:20 and 100:100.

14. A shoe with a shaft, an insole, an outsole and a filling material in between the insole and the outsole to seal and make waterproof the outsole-side end area of the shaft and/or to pad the shoe towards its outsole side end, characterized in that the shaft is bonded to the outsole in such a way that the outsole and/or the insole is provided with at least one insertion opening for putting in the filling material, said filling material being a polyurethane foam which contains as cross-linking components polyol with an OH-number ranging between about 60 to 280 and isocyanate with an NCO-content ranging between about 15 and 25.

* * * * *